US008899590B1

(12) United States Patent
Kahn et al.

(10) Patent No.: US 8,899,590 B1
(45) Date of Patent: Dec. 2, 2014

(54) SPILL-FREE BEER PONG SYSTEM AND COMPONENTS THEREOF

(71) Applicants: Kristopher Paul Kahn, Oconomowoc, WI (US); Ricky Lee Bergmann, Watertown, WI (US)

(72) Inventors: Kristopher Paul Kahn, Oconomowoc, WI (US); Ricky Lee Bergmann, Watertown, WI (US)

(73) Assignee: Skill Pong LLC, Hartland, WI (US)

( * ) Notice: Subject to any disclaimer, the term of this patent is extended or adjusted under 35 U.S.C. 154(b) by 164 days.

(21) Appl. No.: 13/644,291

(22) Filed: Oct. 4, 2012

(51) Int. Cl.
*A63B 63/00* (2006.01)
*F41J 1/00* (2006.01)
*F41J 3/00* (2006.01)

(52) U.S. Cl.
USPC ..... 273/398; 273/342

(58) Field of Classification Search
USPC ..... 273/398, 329, 342; 210/222; 206/217; 607/114; 473/509, 508; 434/250; 426/86
See application file for complete search history.

(56) References Cited

U.S. PATENT DOCUMENTS

| | | | | | |
|---|---|---|---|---|---|
| 1,123,967 | A | * | 1/1915 | Weldon | 220/694 |
| 1,325,436 | A | * | 12/1919 | Cressman | 273/342 |
| 1,879,820 | A | * | 9/1932 | Perry | 215/371 |
| 2,526,165 | A | * | 10/1950 | Smith | 62/457.3 |
| 3,323,706 | A | * | 6/1967 | Gereke | 206/217 |
| 3,804,281 | A | * | 4/1974 | Eckdahl | 215/12.1 |
| 4,388,996 | A | * | 6/1983 | Panicci | 220/603 |
| 5,076,463 | A | * | 12/1991 | McGraw | 220/592.17 |
| 5,294,018 | A | | 3/1994 | Boucher | |
| 5,419,436 | A | * | 5/1995 | Powell | 206/519 |
| 5,996,781 | A | * | 12/1999 | Glaser et al. | 206/217 |
| 7,325,807 | B1 | | 2/2008 | Eason | |
| 7,805,959 | B2 | * | 10/2010 | Webb et al. | 62/457.3 |
| 8,006,980 | B1 | | 8/2011 | Herro et al. | |
| 8,028,995 | B2 | | 10/2011 | Hoffer | |
| 2003/0077360 | A1 | * | 4/2003 | Ramon | 426/86 |
| 2004/0029089 | A1 | * | 2/2004 | Goers et al. | 434/250 |
| 2004/0149598 | A1 | * | 8/2004 | Scarla | 206/217 |
| 2004/0188942 | A1 | | 9/2004 | Trokan | |
| 2011/0220665 | A1 | | 9/2011 | McDonnell et al. | |
| 2013/0134677 | A1 | * | 5/2013 | McDonnell | 273/398 |

OTHER PUBLICATIONS

Webpage download, OfficePlayground, 2010, web.archive.org/web/20101027064047/http:/www.officeplayground.com/Water-Snakes-C225.asp, 1 page.*
Webpage download, amazon, 2011, www.amazon.com/Glow-Dark-Beer-Party-79073/dp/B005GEPCQC/, 1 page.*
Webpage download, About/com, 2008, chemistry.about.com/od/glowinthedarkprojects/a/glowingwater.htm, 2 pages.*

(Continued)

*Primary Examiner* — Gene Kim
*Assistant Examiner* — M Chambers
(74) *Attorney, Agent, or Firm* — DeWitt Ross & Stevens S.C.; Joseph T. Miotke

(57) ABSTRACT

A beer pong system that includes a catch component and a stabilization component. The catch component is configured to be disposed within a hollow cavity of a cup and comprises a compliant surface to aid in preventing a ping pong ball thrown into the hollow cavity from bouncing out. Versions of the catch component include a filler material-filled pouch, a filler material-filled retainer, a catch membrane, and uncontained catch material. The stabilization component stabilizes the cup in an upright position and includes, among other versions, a weight configured to be disposed within the hollow cavity of the cup. The beer pong system enables players to play beer pong with stable cups and ball retention without requiring uncontained liquid in the cup.

20 Claims, 5 Drawing Sheets

(56) References Cited

OTHER PUBLICATIONS

Webpage download, thegreenhead, 2007, www.thegreenhead.com/2006/11/piet-hein-drink-cooler-balls.php, 2 pages.*
Webpage download, Party, 2012, party-wagon.com/childrens-party-blog/2012/5/21/sailing-on-a-jello-ocean.html, 5 pages.*
Webpage download, thekoolstuff, 2011, http://thekoolstuff.com/?tag=crafts-2, 2 pages.*
Webpage download, delasco, 2004,/www.delasco.com/pcat/1/Cosmetic_Surgery/GelEye/GelEye/, 2 pages.*
http://www.barsupplies.com/beer-pong-pack-frozen-racks-wballs-p-13229.html.
http://www.bpong.com/store/.
http://www.kegworks.com/bar-accessories-fun-stuff-725.
http://pongstar.com/.
http://unique-gifts.spencersonline.com/search#view=grid&w=beer%20pong.

* cited by examiner

SPILL-FREE BEER PONG SYSTEM AND COMPONENTS THEREOF

FIELD OF THE INVENTION

The present invention is directed to a spill-free beer pong system and components thereof.

BACKGROUND

Beer pong, or Beirut, is a popular party game, particularly among young people such as college students. Although there are many local variations in the rules of the game, there are several generally shared commonalities. The game is typically played on a conventional ping pong table or a table similar in dimensions to a ping pong table but without the net across the center of the table. The game comprises two teams. The teams have a group of drinking cups, e.g., 16-ounce cups, arranged in a close fitting triangular pattern, similar to racked billiard balls, placed centrally at opposite ends of the table. The cups are filled, or half-filled, with a beverage, typically beer, although malt liquor or other alcoholic or nonalcoholic beverages may be substituted therefor.

The purpose of the game is for each team to take turns trying to eliminate the other team's cups by throwing, bouncing, or hitting ping pong balls into the cups. Any cup into which a ping pong ball falls will be taken out of play, and a member of the team whose cup was eliminated typically drinks the beer or other beverage contained in the cup. Depending upon the number of cups remaining, the cups may be rearranged into a diamond configuration or other configuration as cups are eliminated. The objective is to eliminate the opposing team's cups first, and the victor is the team that does so.

Various references describing beer pong and components therefor include U.S. Pat. No. 7,805,959 to Webb et al., U.S. Publication 2004/0188942 to Trokan, and U.S. Publication 2011/0220665 to McDonnell et al.

It is often desirable to play beer pong without liquid in the cups, for example, to prevent spills, splashes, or other messes. However, this poses a problem because the cups are then prone to tipping over when the ping pong ball contacts the cup. Further, the balls often bounce out of the cup after landing therein. There is a need for a beer pong system and components thereof that enable a player to play beer pong without uncontained liquid in the cup but without the associated problems of cup instability or lack of ball retention in the cup.

SUMMARY OF THE INVENTION

The present invention addresses the aforementioned need.

The invention provides a beer pong system. One version of the beer pong system includes a catch component and a stabilization component. The catch component comprises a compliant surface capable of being disposed within a hollow cavity of a cup with the compliant surface facing an upper opening of the cup. The hollow cavity is defined by a continuous side wall extending from a bottom wall of the cup and has an upper end and a lower end. The upper opening is defined by a rim of the side wall at the upper end of the hollow cavity. The stabilization component is capable of being physically connected to the cup or disposed within the hollow cavity to stabilize the cup against a support surface with the upper opening of the hollow cavity substantially opposed with respect to the support surface. The catch component and the stabilization component preferably do not comprise uncontained liquid.

Another version of the beer pong system includes a cup, a catch component, and a stabilization component. The cup comprises a continuous side wall extending from a bottom wall that defines a hollow cavity having an upper and a lower end. A rim of the side wall defines an opening at the upper end of the hollow cavity. The catch component comprises a compliant surface disposed within or configured to be disposed within the hollow cavity of the cup with the compliant surface facing the upper opening of the cup. The stabilization component is capable of being physically connected to the cup or disposed within the hollow cavity to stabilize the cup against a support surface with the upper opening of the hollow cavity substantially opposed with respect to the support surface. It is preferred that the hollow cavity is devoid of uncontained liquid.

The invention also provides beer pong components. One version of a beer pong component comprises a flexible pouch containing a viscous, elastic, or viscoelastic material and including a compliant surface. The flexible pouch is configured to be disposed within a hollow cavity of a cup with the compliant surface facing an upper opening of the cup.

The invention also provides methods of playing games such as beer pong or variations thereof. One version comprises obtaining a cup, a catch component, and a stabilization component as described above, physically connecting the stabilization component to the cup or disposing the stabilization component within the cup if not already physically connected to or disposed within the cup, inserting the catch component within the hollow cavity of the cup if not already disposed therein, and projecting an object into the hollow cavity. The catch component increases the likelihood of retaining the object within the cup or substantially prevents the object from bouncing out of the cup. The stabilization component decreases the likelihood that the cup will be knocked over as the object contact the cup.

The objects and advantages of the invention will appear more fully from the following detailed description of the preferred embodiment of the invention made in conjunction with the accompanying drawings.

DETAILED DESCRIPTION OF THE INVENTION

Figure 1:
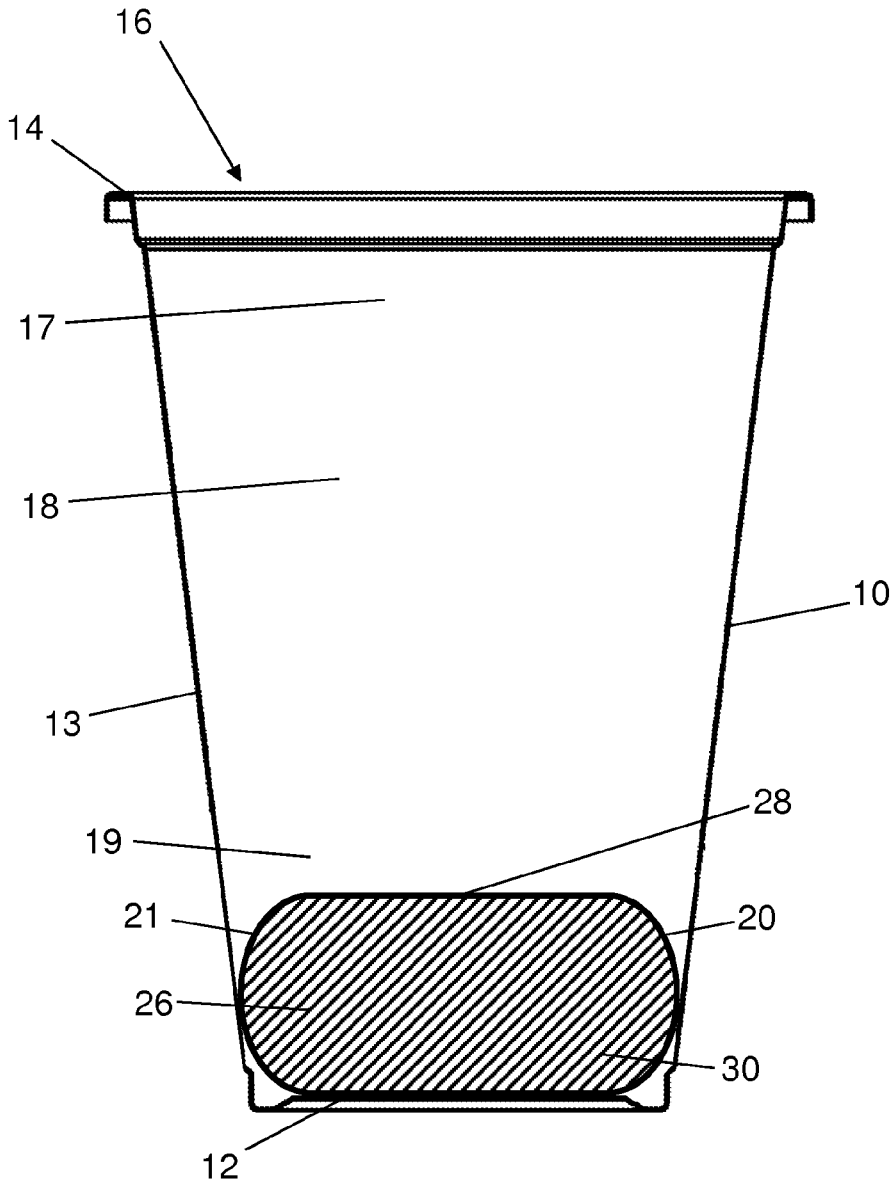
FIG. 1 depicts a side elevation view of a spill-free beer pong system of the present invention comprising a liquid-filled pouch as a catch component and stabilization component.

The beer pong system of the present invention may comprise a cup 10. See FIGS. 1-4B for exemplary cups 10. The cup 10 includes a continuous side wall 13 extending from a bottom wall 12 that defines a hollow cavity 18 having an upper end 17 and a lower end 19. As used herein, "continuous" means that there are no substantial gaps within the side wall 13, such as a gap that would permit an object thrown into the hollow cavity 18 from passing through the side wall 13. The continuous side wall 13 may have any cross-sectional shape, including a circular cross-sectional shape (see FIG. 4B), a rectangular cross-sectional shape, etc. The side wall 13 comprises a rim 14 that defines an opening 16 at the upper end 17 of the hollow cavity 18.

The beer pong system of the present invention comprises a catch component 20. See FIGS. 1-4A for exemplary versions of the catch component 20. The catch component 20 is disposed within or configured to be disposed within the hollow cavity 18. The catch component 20 provides a compliant surface 28 that faces the upper opening 16 of the cup 10 to dampen or cushion an object, such as a ping pong ball, projected into the hollow cavity 18 to substantially prevent the object from bouncing out of the cup 10. The term "compliant" used herein to refer to such elements as catch components 20, surfaces thereof, or materials comprised therein, indicates that the element has the property of yielding to a force, such as an object impinging on the element. A compliant element preferably exhibits viscous, elastic, or viscoelastic properties. "Viscous," "elastic," and "viscoelastic" refer to any degree of exhibited viscosity, elasticity, or viscoelasticity, respectively.

As shown in FIG. 1, the catch component 20 in some versions of the invention comprises a pouch 21 containing a filler material 26. The term "contained" used herein to refer to one or more first materials means that the first materials are fully confined within one or more second materials that are, preferably, substantially impermeable to the first materials. "Uncontained" means that the first materials are not contained within one or more second materials.

The pouch 21 is preferably substantially impermeable to the filler material 26 contained therein and is preferably comprised of a flexible and/or an elastic, stretchable material. The filler material 26 is preferably comprised of a viscous, elastic, viscoelastic, or resilient material. The pouch 21 wholly surrounds and entirely encompasses the filler material 26 contained therein. The filler material 26 preferably at least slightly distends the pouch 21 to form a pillow-like configuration. The pouch 21 provides a cushion for an incoming object by virtue of the viscous, elastic, or viscoelastic properties of the filler material 26, elastic properties of the container material, or a combination thereof.

The pouch 21 may be made of any material suitable for containing a given filler material 26. Plastic or rubber materials are preferred for containing fluids. Various textile-like fabrics or netting may be used for containing solids. The pouch 21 may be made from natural or synthetic materials including but not limited to cotton, wool, silk, cellulose, rubber, latex, nylon, modacrylic, olefin, acrylic, polyester, vinyon, saran, spandex, vinalon, aramids, modal, lyocell, cellophane, PLA, derclon, rayon, polyethylene, polypropylene, polyethylene terephthalate, polychloroprene, polyamide, polyacrylonitrile, polytetrafluoroethylene, or combinations thereof.

The filler material 26 may be a fluid, such as a gas, liquid, gel, or paste; a solid; or a combination thereof. The fluid filler material 26 preferably has a viscosity at room temperature less than about 100,000,000 cP, such as less than about 10,000,000 cP, less than about 1,000,000 cP, less than about 500,000 cP, or less than about 250,000 cP. The solid filler material 26 preferably has a Shore 00 durometer hardness less than about 80, less than about 70, less than about 60, less than about 50, less than about 40, less than about 30, less than about 20, or less than about 10.

Suitable gases for the filler material 26 include atmospheric air, oxygen, nitrogen, or combinations thereof, among others. A preferred gas is atmospheric air. Suitable liquids include any inert liquid, such as water-based liquids, oil-based liquids, or a combination thereof. A preferred liquid is water. Suitable gels or pastes include silicone-based gels, hydrogels made from various polymers such as polyvinyl alcohol, sodium polyacrylate, acrylate polymers, copolymers with an abundance of hydrophilic groups, and others. Suitable solids may comprise a unitary piece of compliant material; a plurality of particles, chunks, or pieces of material; bunched strands or filaments of material; or folded, crumpled, or bunched sheets of material. Examples of suitable unitary pieces of material include a piece of unitary foam (resilient foam, memory foam, etc.), polymer elastomer, and carpet, among others. Examples of particles, chunks, or pieces of material include pieces of foam, pieces of paper or cellulose-based products, wood chips, and cotton balls, among others. Examples of bunched strands include cotton, hair, yarn, shredded paper products, rubber bands, and synthetic and natural fibers, among others. Examples of sheets of material include office paper, paper towels, facial tissues, clothing, clothing fabric, cloth, and carpet, among others. The solid materials may be made from any natural or synthetic material capable of providing a compliant surface 28, including cotton, wool, silk, hair, cellulose, rubber, latex, nylon, modacrylic, olefin, acrylic, polyester, vinyon, saran, spandex, vinalon, aramids, modal, lyocell, cellophane, PLA, derclon, rayon, polyethylene, polypropylene, polyethylene terephthalate, polychloroprene, polyamide, polyacrylonitrile, polytetrafluoroethylene, other non-listed polymers, or combinations thereof.

The pouch 21 may be permanently sealed in a manner that requires destroying it to remove the filler material 26. Alternatively, the pouch 21 may be sealed by virtue of a re-sealable opening. Examples of re-sealable openings include openings closable by zippers, buttons, look-and-loop fasteners, ZIPLOCK-like closures, etc., depending on the type of filler material 26 contained therein. The pouch 21 can either be removable from the cup 10 or can be attached to a portion of the cup 10, such as a side wall 13 or bottom wall 12.

Figure 2:
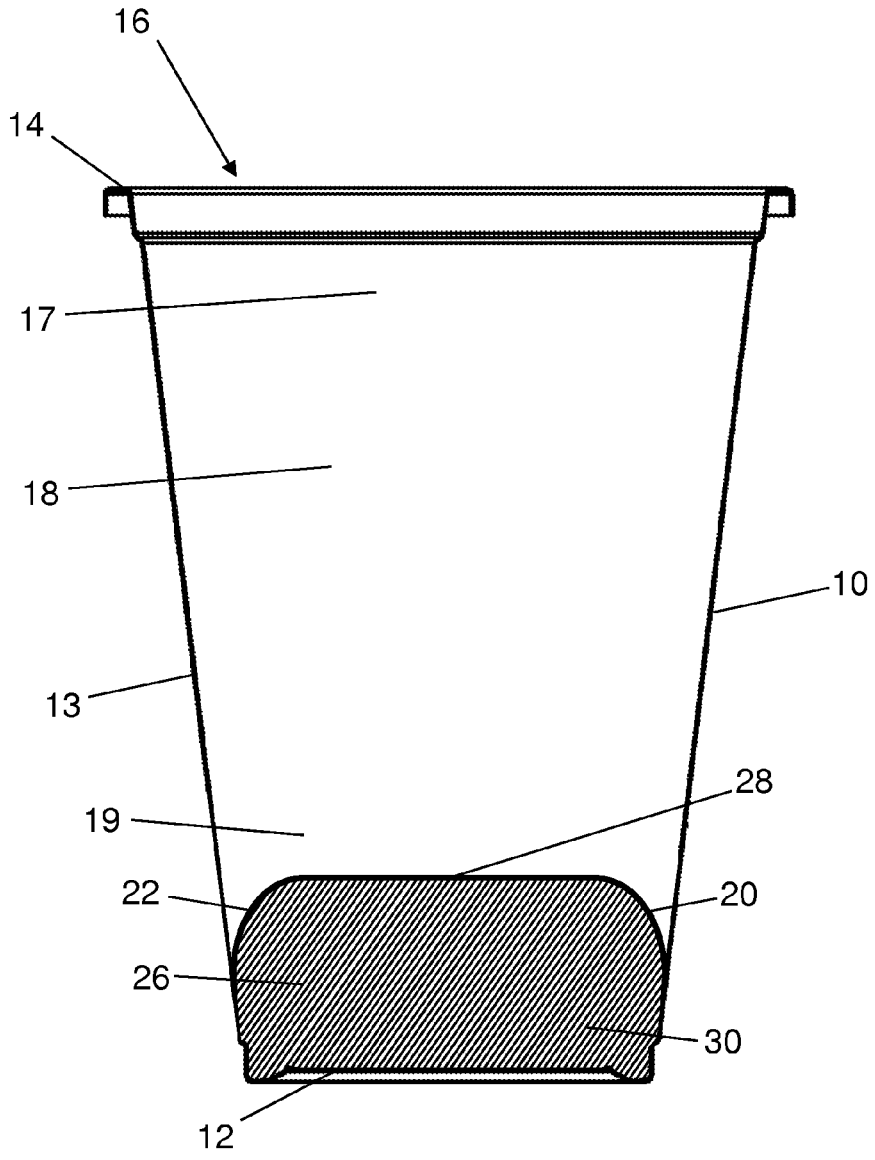
FIG. 2 depicts a side elevation view of a spill-free beer pong system of the present invention comprising a liquid-filled retainer as a catch component and stabilization component.

As shown in FIG. 2, the catch component 20 in some versions of the invention comprises filler material 26 contained within the lower end 19 of the hollow cavity 18 of the cup 10 by a retainer 22 23 impermeable to the filler material. The retainer 22 preferably comprises individual strands, netting, or sheets of material. The material is preferably a flexible and/or elastic material. The retainer 22 attaches to various portions of the side wall 13 or bottom wall 12 of the cup 10 to contain the filler material 26 between the bottom of the cup 10 and the container material. The retainer 22 may be attached to opposed portions of the side wall 13, at regular intervals around the perimeter of the side wall 13, around the entire perimeter of the side wall 13 (see, e.g., FIG. 2), at various portions of the bottom wall 12, or other configurations of attachment. The retainer 22 may be permanently attached to the cup 10, such as with a glue or other adhesive, or may be reversibly attached with a reversible fastener, such as hook-and-loop fasteners and the like. The retainer 22 may be at least slightly distended by the filler material 26, as shown in FIG. 2, or may loosely drape over the filler material 26. The retainer 22 may comprise any material described above for the pouch 21. Similarly, the filler material 26 contained by the retainer 22 may comprise any material described above as being suitable for being contained within a pouch 21. The filler retainer 22 provides a cushion for an incoming object by virtue of viscous, elastic, or viscoelastic properties of the filler material 26, elastic properties of the container material, or a combination thereof.

Figure 3:
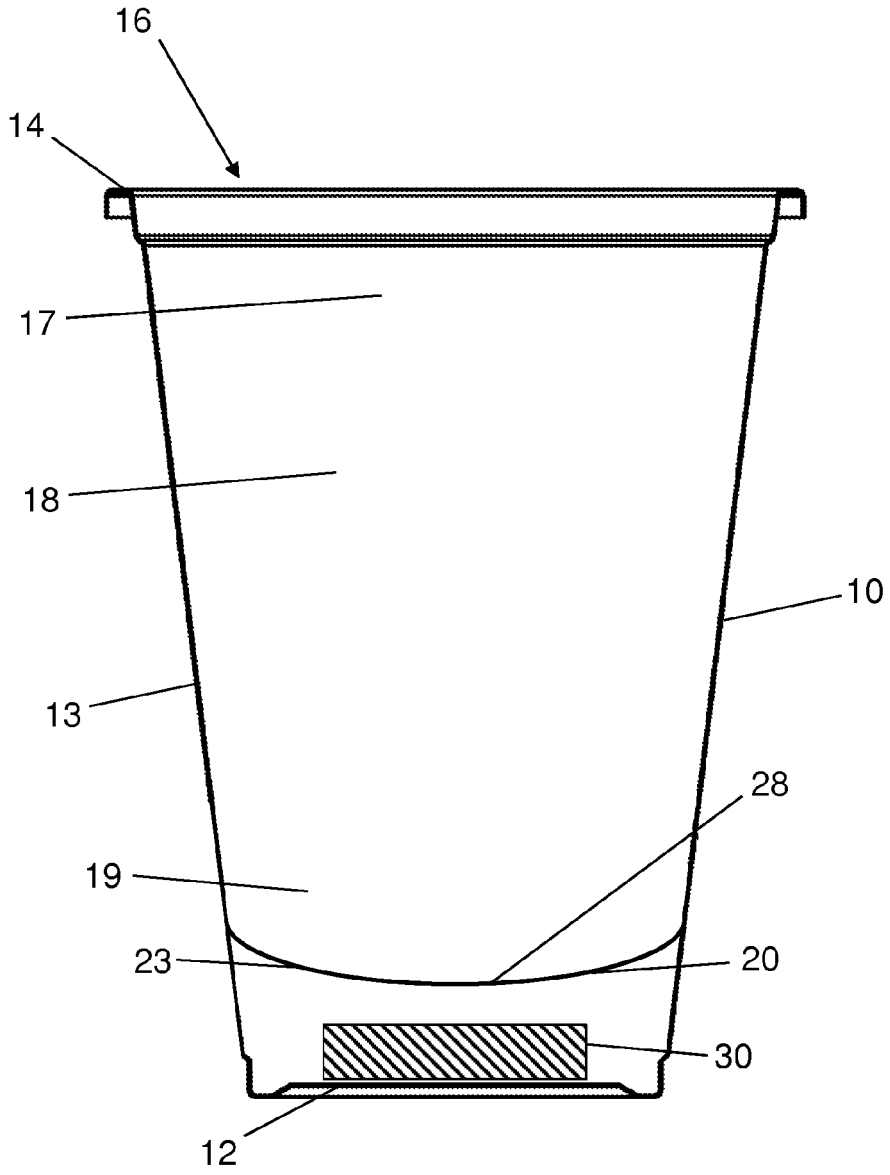
FIG. 3 depicts a side elevation view of a spill-free pong system of the present invention comprising a catch membrane as a catch component and a separate weight as a stabilization component.

As shown in FIG. 3, the catch component 20 in some versions of the invention comprises a catch membrane 23. The catch membrane 23 comprises individual strands, mesh, netting, or sheets of material (cloth, textiles) suspended above the bottom wall 12 of the cup 10. The catch membrane 23 is preferably made of an elastic material that dampens the impact of any incoming object to prevent the object from bouncing out of the cup 10. The catch membrane 23 may be attached to the side wall 13 of the cup 10 (see, e.g., FIG. 3) or may be disposed within a frame that is configured to be disposed within the hollow cavity 18 of the cup 10. If attached to the side wall 13 of the cup 10, the catch membrane 23 may be attached to opposed portions of the side wall 13, at regular intervals around the perimeter of the side wall 13, around the entire perimeter of the side wall 13, or other configurations of attachment. The catch membrane 23 may be permanently attached to the cup 10 or frame, such as with a glue or other adhesive, or may be reversibly attached with a reversible fastener, such as hook-and-loop fasteners and the like. The catch membrane 23 may comprise any material described above for the pouch 21.

Figure 4A:
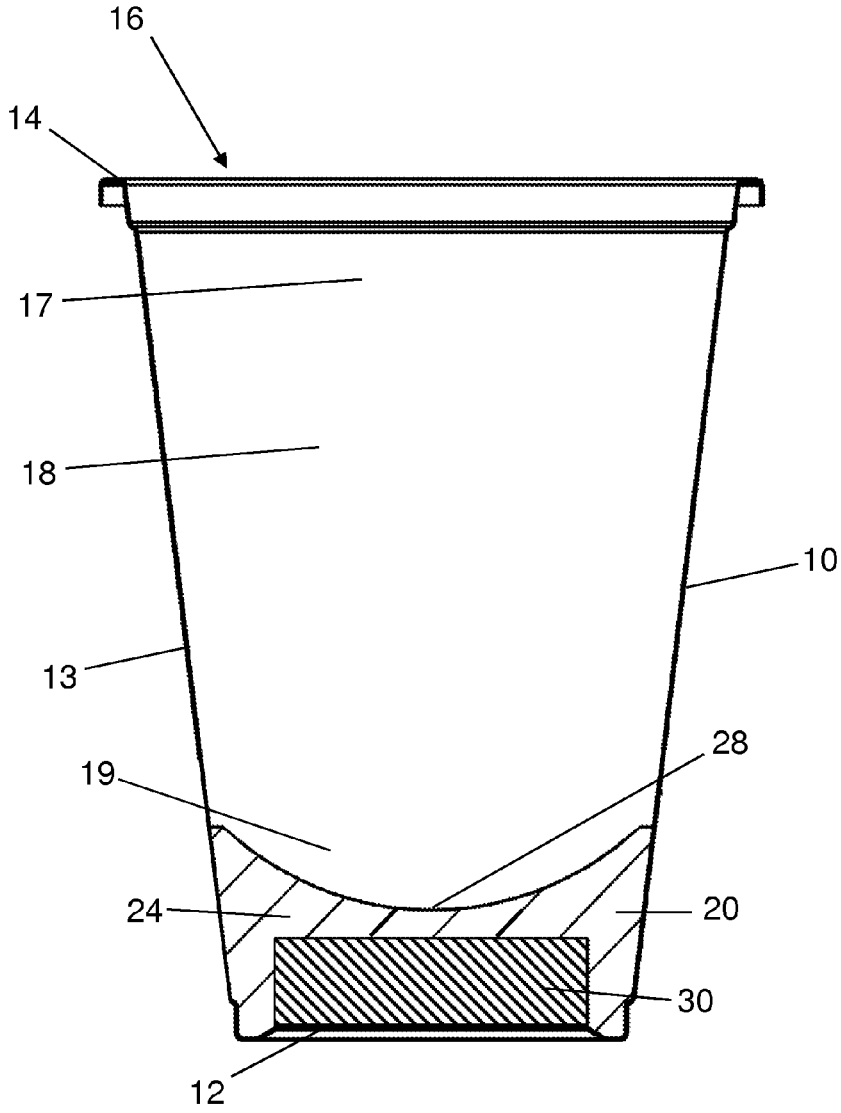
FIG. 4A depicts a side elevation view of a spill-free pong system of the present invention comprising an uncontained foam catch material as a catch component and a separate weight as a stabilization component.
Figure 4B:
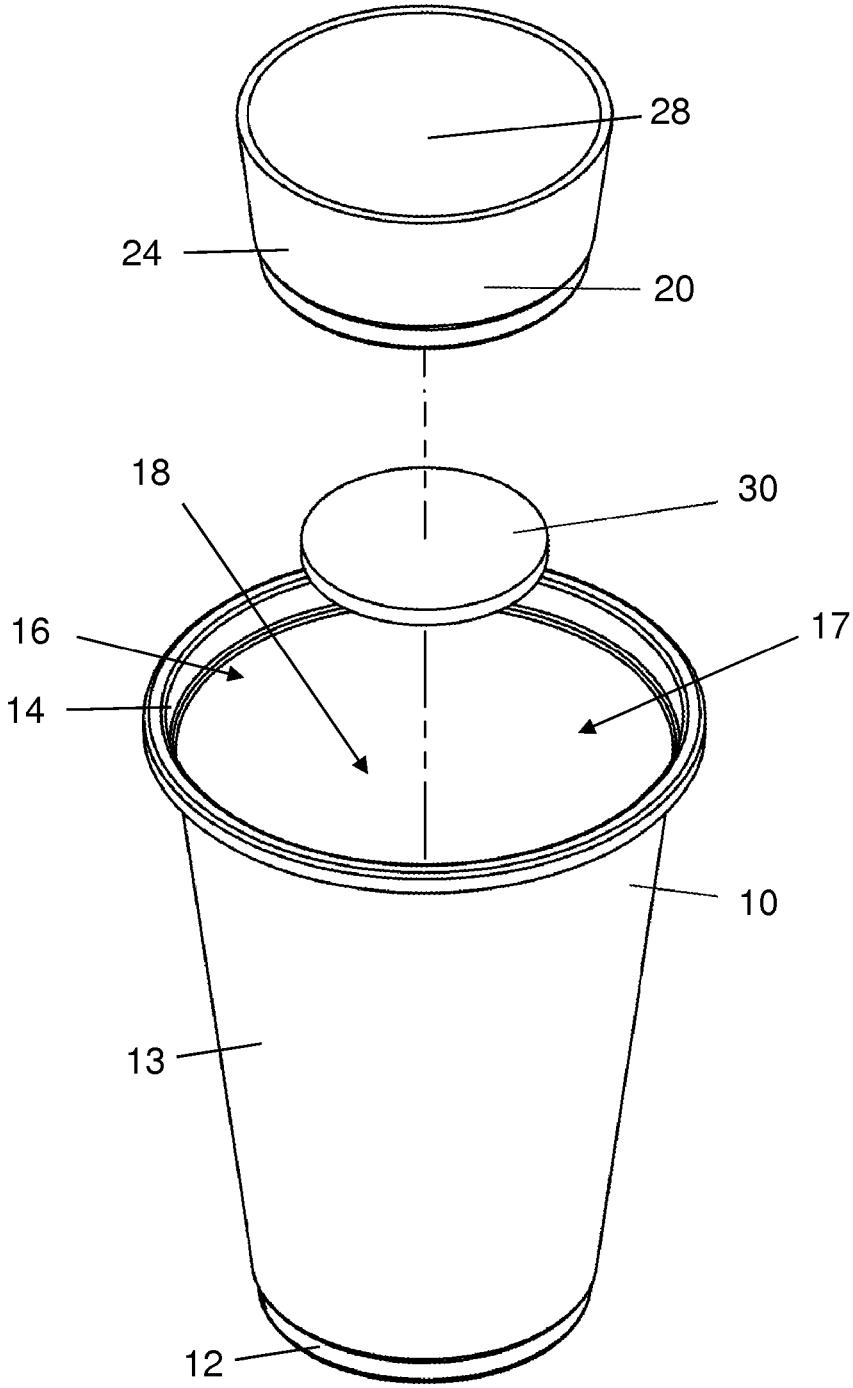
FIG. 4B depicts an exploded perspective view of a spill-free pong system of the present invention comprising an uncontained foam catch material as a catch component and a separate weight as a stabilization component.

As shown in FIGS. 4A and 4B, the catch component 20 in some versions of the invention comprises uncontained catch material 24 disposed within the lower end 19 of the hollow cavity 18. The uncontained catch material 24 is preferably loosely disposed within the cup 10 but may be attached to various portions of the cup 10. The uncontained material preferably comprises a solid, such as any of the solid filler material 26 and properties thereof described above. The material constituting the catch component 20 either itself comprises a compliant surface 28 or can be configured to form a compliant surface 28. In the case of a unitary piece of material, the compliant surface 28 may comprise a substantially continuous surface provided by the surface of the piece of material. In other cases, the compliant surface 28 may comprise a furrowed surface demarcated by the limit of extension of the collected, bunched, crumpled, or folded material within the hollow cavity 18.

In a preferred version of the invention, the system or any parts thereof, is devoid of uncontained liquid. Such a version explicitly excludes uncontained beer or water in a cup 10 as constituting a catch component 20 and/or a stabilization component 30 (see below). Preferably, the catch component 20 and the stabilization component 30 does not comprise uncontained liquid.

Regardless of the configuration of the catch component 20, the compliant surface 28 formed thereby preferably has a Shore 00 durometer hardness less than about 80, less than about 70, less than about 60, less than about 50, less than about 40, less than about 30, less than about 20, or less than about 10. Such a relatively low degree of hardness helps to prevent an incoming object, such as a ping pong ball, from bouncing out of the cup 10.

The catch component 20 is preferably configured to position the compliant surface 28 toward the lower end 19 of the hollow cavity 18. This helps to capture the incoming object. In some versions, the catch component 20 is configured to position the compliant surface 28 from the lower end 19 of the hollow cavity 18 no more than one half a distance between the upper end 17 and the lower end 19 of the hollow cavity 18, such as no more than one third a distance between the upper end 17 and the lower end 19 of the hollow cavity 18 or no more than one fourth a distance between the upper end 17 and the lower end 19 of the hollow cavity 18.

The catch component 20 may comprise an adhesive element to reversibly attached to the incoming object after making contact. For example, the compliant surface 28 of the catch component 20 may comprise a sticky or adhesive surface. The sticky surface may be provided by sticky paper, a sticky gel, double-sided tape, etc. Alternatively, the surface and object combination may each comprise opposing sides of hook-and-loop fastener such that the hooks and loops become engaged when the object and the surface come in contact.

The beer pong system further comprises a stabilization component 30. See FIGS. 1-4B for exemplary versions of the stabilization component 30. The stabilization component 30 stabilizes the cup 10 against a support surface, such as a table and the like, in an upright position, i.e., with the upper opening 16 of the hollow cavity 18 substantially opposed with respect to the support surface.

As shown in FIGS. 1-4B the stabilization component 30 in preferred versions of the invention comprises a weight. The weight is preferably attached to or incorporated within a lower portion of the cup 10, such as the bottom wall 12 or a lower portion of the side wall 13. The weight may also be placed within the lower end 19 of the hollow cavity 18 of the cup 10, such as between the compliant surface 28 and the bottom wall 12 of the cup 10, and maintained therein by gravity. The weight makes the system bottom-heavy and prevents the cup 10 from tipping over when an object contacts it. In some versions, the weight is positioned from the bottom wall 12 of the cup 10 no more than one half a distance between the bottom wall 12 and the rim 14 of the cup 10, such as no more than one third a distance between the bottom wall 12 and the rim 14 of the cup 10 or no more than one fourth a distance between the bottom wall 12 and the rim 14 of the cup 10. In other versions, the weight is positioned from the lower end 19 of the hollow cavity 18 no more than one half a distance between the upper end 17 and the lower end 19 of the hollow cavity 18, such as no more than one third a distance between the upper end 17 and the lower end 19 of the hollow cavity 18 or no more than one fourth a distance between the upper end 17 and the lower end 19 of the hollow cavity 18. The weight preferably is at least about 1% the weight of the cup 10, at least about 2.5% the weight of the cup 10, at least about 5% the weight of the cup 10, at least about 10% the weight of the cup 10, at least about 15% the weight of the cup 10, at least about 20% the weight of the cup 10, at least about 30% the weight of the cup 10, at least about 40% the weight of the cup 10, at least about 50% the weight of the cup 10, at least about 60% the weight of the cup 10 or more. The weight may comprise any material capable of fitting near the lower end 19 of the hollow cavity 18 and providing suitable weight. Examples include contained or uncontained liquids (e.g., water), gels, solids, sand, stones, gravel, solid metal weights, metal-weighted chips, weighted plastics, or any other dense material.

In some versions of the invention, the catch component 20 is also the stabilization component 30. This may occur in versions of the invention wherein the catch component 20 or portion thereof, such as the pouch 21, retainer 22, catch membrane 23, filler material 26, and/or catch material 24, provides a suitable weight in a suitable portion of the hollow cavity 18. This is shown in FIG. 1, wherein the liquid in the fluid-filled pouch 21 provides a suitable weight in a suitable portion of the hollow cavity 18 in addition to providing compliance. Another example is an elastomer or other uncontained catch material 24 that provides a suitable weight in a suitable portion of the hollow cavity 18 while also providing a compliant surface 22.

In other versions of the invention, the catch component 20 is separate from the stabilization component 30. This may occur in versions of the invention wherein the catch component 20 does not provide a suitable weight in a suitable portion of the hollow cavity 18 and a supplemental weight is required. This is shown in FIGS. 4A and 4B, wherein the stabilization component 30 comprises a solid weight configured to fit in a complementary cut-out 32 of a foam catch component 20. Other examples comprising a separate stabilization component 30 are gas-filled pouches 21 or retainers 22, or most catch membranes 23, which do not provide a suitable weight.

In other versions of the invention, the stabilization component 30 comprises a magnet either attached to the cup 10 or insertable within the hollow cavity 18 that attracts to an opposed magnet on a support surface. In yet other versions of the invention, the stabilization component 30 comprises one or more suction cups 10 attached to the underside of the bottom wall 12 of the cup 10 capable of suctioning against the support surface. In yet other versions of the invention, the stabilization component 30 comprises flanges about the side walls 13 of the cup 10 or a tray into which the cup 10 may be placed to effectively increase the surface contact on the support surface.

Beer pong is often played in a dimly lit or dark room. Sometimes a black light is present. To help view the components of the beer pong system, one or more of the components of the system, including the cup 10, the stabilization component 30, the catch component 20 or any subcomponent thereof, such as a pouch 21, filler material 26, a retainer 22, a catch membrane 23, or uncontained catch material 24, etc., may be chemiluminescent, photoiluminescent, and/or black-light reactive. For example, a clear pouch 21 may be filled with a chemiluminescent, photoiluminescent, or black-light reactive material, or the pouch 21 itself may be comprised of a chemiluminescent, photoiluminescent, or black-light reactive material. Additionally or alternatively, one or more of the components of the system may comprise lights, such as LED lights.

To indicate that an object has successfully been projected into a cup 10, the compliant surface 28 of the catch component 20 may comprise a touch- or pressure-sensitive sensor configured to project a signal when triggered. The signal may include illumination of lights, sounds effects (which may include customizable voice recordings or popular expressions), electronic holograms or holographic effects, projection of 3D images, and/or other signals.

The pouch 21 and retainer 22 may further contain various inserts along with the filler material 26. Such inserts may help to identify specific cups 10 in certain variations of beer-pong games. Various inserts may include specifically-colored liquid, glitter, bubbles, fish replicas, miniature dioramas, minors, other small objects, etc.

Any of the various components described herein may also comprise various logos, designs, holograms, which may be used for promotional purposes.

The invention further includes methods of playing a game such as beer pong or a variation thereof. One method includes obtaining any cup 10, catch component 20, and/or stabilization component 30 described herein, physically connecting the stabilization component 30 to the cup 10 or disposing the stabilization component 30 within the cup 10 if not already physically connected to or disposed within the cup 10, inserting the catch component 20 within the hollow cavity 18 of the cup 10 if not already disposed therein, and projecting an object into the hollow cavity 18, wherein the catch component 20 increases the likelihood of retaining the object within the cup 10 or substantially prevents the object from bouncing out of the cup 10. In projecting the object, the object may be thrown, bounced, or hit, such as with a ping pong paddle.

As used herein, the term "beer pong system" is a term of convenience is does not limit any components described herein to be used only in the game of beer pong as commonly understood in the art.

Each beer pong system component described herein may be permanently attached to the other components or may be detachable therefrom and provided separately.

The elements and method steps described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference to the same extent as if each individual reference were specifically and individually indicated as being incorporated by reference. In case of conflict between the present disclosure and the incorporated references, the present disclosure controls.

It is understood that the invention is not confined to the particular construction and arrangement of parts herein illustrated and described, but embraces such modified forms thereof as come within the scope of the following claims.

We claim:

1. A beer pong system comprising:

a cup comprising a continuous side wall extending from a bottom wall that defines a hollow cavity having an upper and a lower end, wherein the side wall comprises a rim that defines an opening at the upper end of the hollow cavity;

a catch component comprising a compliant surface disposed within or capable of being disposed within the hollow cavity with the compliant surface facing the upper opening; and a stabilization component capable of being physically connected to the cup or disposed within the hollow cavity to stabilize the cup against a support surface with the upper opening of the hollow cavity substantially opposed with respect to the support surface, wherein the hollow cavity is devoid of uncontained liquid, wherein the compliant surface comprises an adhesive element oriented towards the upper end of the hollow cavity, and wherein a ping pong ball will reversibly attach to the adhesive element when the ping pong ball is inserted through the opening at the upper end of the hollow cavity.

2. The system of claim 1 wherein the catch component comprises an element selected from the group consisting of a flexible pouch containing a viscous, elastic, or viscoelastic material and a retainer containing a viscous, elastic, or viscoelastic material.

3. The system of claim 2 wherein the viscous, elastic, or viscoelastic material comprises a fluid.

4. The system of claim 3 wherein the fluid is a liquid.

5. The system of claim 3 wherein the fluid is a gel or paste.

6. The system of claim 2 wherein the viscous, elastic, or viscoelastic material comprises a solid having a Shore OO durometer hardness less than about 80.

7. The system of claim 2 wherein the stabilization component comprises the viscous, elastic, or viscoelastic material.

8. The system of claim 1 wherein the catch component comprises an uncontained catch material.

9. The system of claim 8 wherein the catch component comprises a cut-out to accommodate the weight within the hollow cavity between the compliant surface and the bottom wall of the cup.

10. The system of claim 1 wherein the catch component comprises a contained viscous, elastic, viscoelastic, or resilient material.

11. The system of claim 1 wherein the catch component and the stabilization component comprise a same component.

12. The system of claim 1 wherein the catch component and the stabilization component comprise separate components.

13. The system of claim 1 wherein the stabilization component comprises a weight separate from the catch material.

14. The system of claim 1 wherein the catch component comprises a catch membrane.

15. The system of claim 1 wherein the compliant surface of the catch component has a Shore OO durometer hardness less than about 80.

16. The system of claim 1 wherein the catch component is configured to position the compliant surface from the lower end of the hollow cavity no more than one half a distance between the upper end and the lower end of the hollow cavity.

17. The system of claim 1 wherein the stabilization component comprises a weight having at least 5% weight of the cup that is configured to be disposed within the hollow cavity between the compliant surface and the bottom wall of the cup.

18. The system of claim 1 wherein an element selected from the group consisting of the cup, the catch component, and the stabilization component comprises a chemiluminescent, photoiluminescent, or black-light reactive portion.

19. A beer pong game component comprising an insert having a compliant and adhesive surface and a cup comprising a continuous side wall extending from a bottom wall that defines a hollow cavity having an upper and a lower end, wherein the side wall comprises a rim that defines an opening at the upper end of the hollow cavity, and wherein the insert is configured to be disposed within the hollow cavity of the cup proximate the lower end of the cup, with the compliant and adhesive surface facing an upper opening of the cup and wherein the compliant and adhesive surface will reversibly attach to a ping pong ball that is inserted into the hollow cavity of the cup through the upper opening.

20. A method of playing a game comprising obtaining a cup, a catch component, and a stabilization component as described in claim 1, physically connecting the stabilization component to the cup or disposing the stabilization component within the cup if not already physically connected to or disposed within the cup, inserting the catch component within the hollow cavity of the cup if not already disposed therein, and projecting an object into the hollow cavity, wherein the catch component increases the likelihood of retaining the object within the cup and the adhesive element of the compliant surface reversibly attaches the to the object.

* * * * *